United States Patent [19]

Williams et al.

[11] 3,948,237

[45] Apr. 6, 1976

[54] FUEL SUPPLY SYSTEMS FOR ENGINES

[75] Inventors: Malcolm Williams, Solihull; Christopher Robin Jones, Alcester; Richard William Crookes, Solihull, all of England

[73] Assignee: C.A.V. Limited, Birmingham, England

[22] Filed: Dec. 28, 1973

[21] Appl. No.: 429,171

[30] Foreign Application Priority Data

Jan. 6, 1973 United Kingdom ..... 888/73

[52] U.S. Cl. ..... 123/139 E; 123/32 EA; 290/40 A

[51] Int. Cl. ..... F02m 39/00; F02b 3/00

[58] Field of Search ..... 123/139 E, 102, 32 EA; 290/40 A; 60/39.28

[56] References Cited

UNITED STATES PATENTS

| | | | |
|---|---|---|---|
| 3,699,935 | 10/1972 | Adler | 123/139 E |
| 3,765,380 | 10/1973 | Rachel | 123/32 EA |
| 3,777,174 | 12/1973 | Butscher | 123/139 E |
| 3,800,750 | 4/1974 | Reddy | 123/32 EA |

*Primary Examiner*—Charles J. Myhre
*Assistant Examiner*—Ronald B. Cox
*Attorney, Agent, or Firm*—Holman & Stern

[57] ABSTRACT

An engine fuel system, particularly for a compression ignition engine, has a control arrangement for determining the quantity of fuel injected in accordance with the position of a control member such as an accelerator pedal. For part of its movement, the pedal produces an output which is a certain function of the pedal position, and for another part of the movement, an output is produced which is a different function of the pedal position.

2 Claims, 4 Drawing Figures

FUEL SUPPLY SYSTEMS FOR ENGINES

This invention relates to fuel systems for engines, particularly, but not exclusively, compression-ignition engines.

A system according to the invention includes control means determining the rate of supply of fuel to the engine, and a demand transducer providing an input to the control means to influence the output thereof, said demand transducer comprising a control member movable progressively from a zero demand position to a maximum demand position, and a control network which when the control member is moved from the zero demand position produces an output which is a function of the position of the control member until a predetermined position of the control member is reached, whereafter the control network produces an output which is a different function of the position of the control member.

Figure 1:
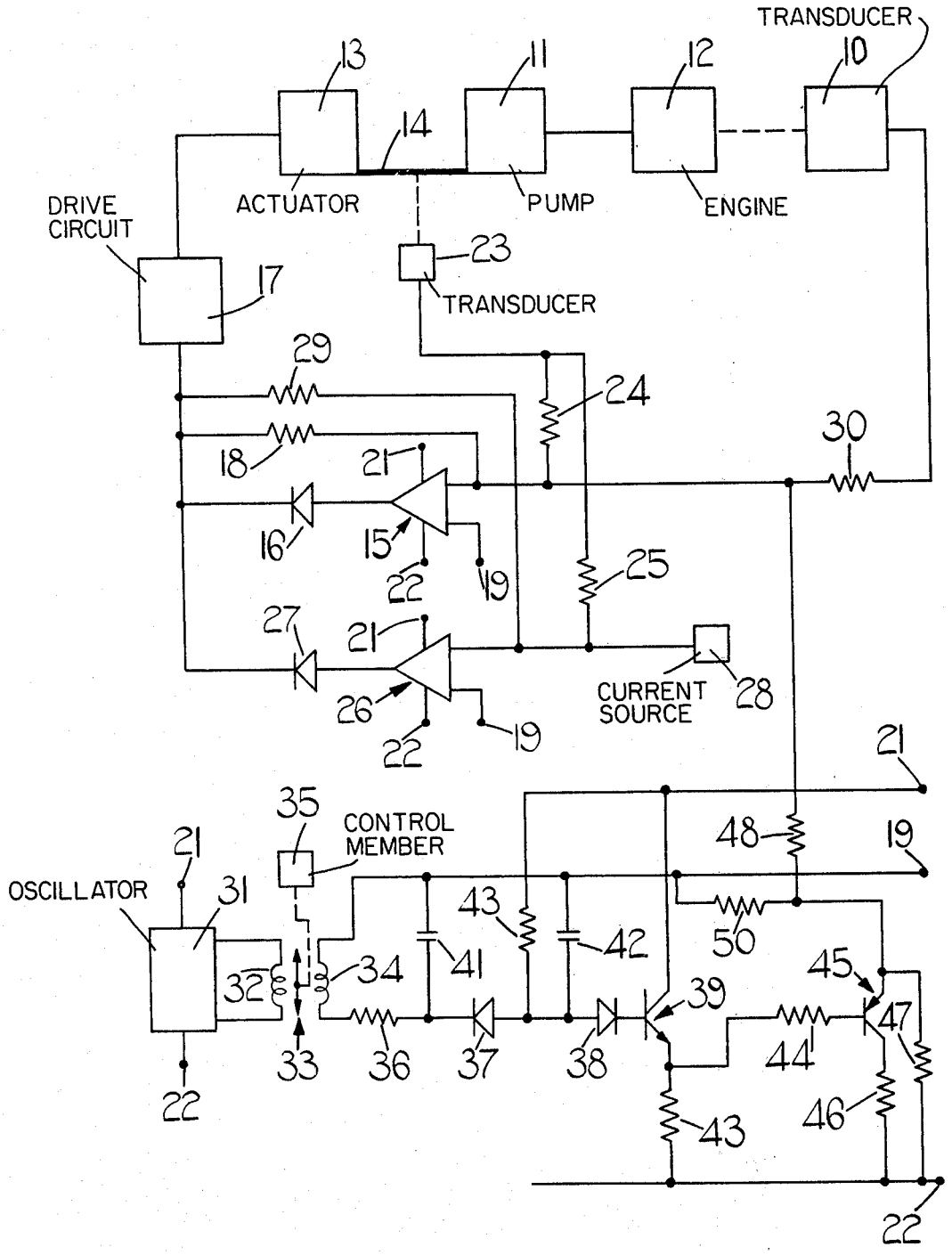

Preferably, said different function is a constant. In one arrangement, the control network produces an output which increases with movement of the control member at a first rate until an intermediate position is reached, and then increases at a second rate until the predetermined position is reached. In this case, the control network preferably includes a transistor which gives the three required rates by virtue of being saturated, conductive but not saturated, and off respectively. Preferably, the transistor is saturated between the zero demand position and the intermediate position, conductive but not saturated between the intermediate and predetermined positions, and off when the control member is beyond the predetermined position. An example of the invention is illustrated in the accompanying drawings, in which:

FIG. 1 is a circuit diagram, and

Figure 2:
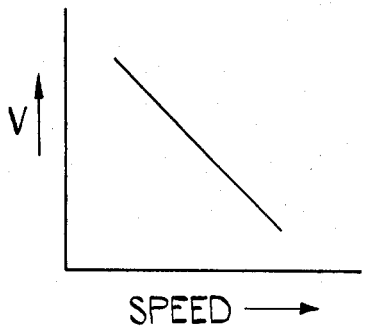
Figure 3:
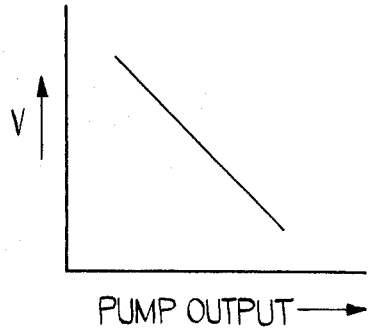
Figure 4:
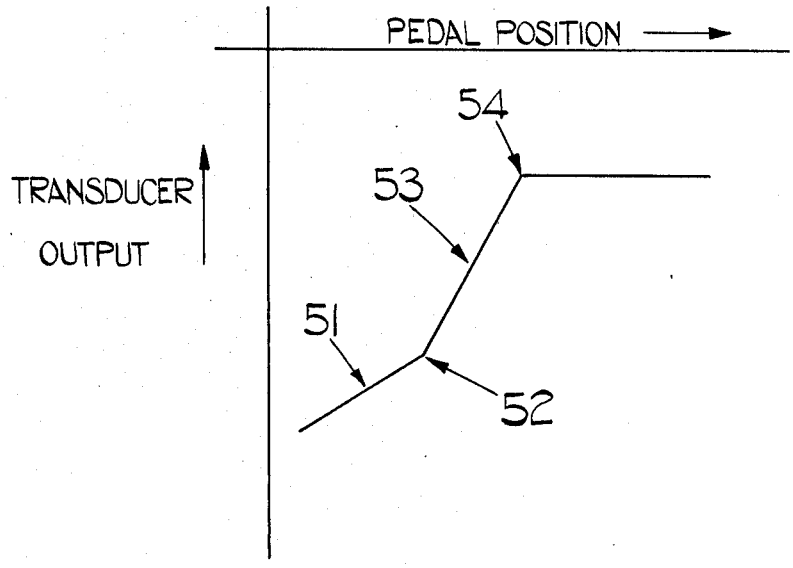

FIGS. 2, 3 and 4 respectively illustrate the output of three transducers used in FIG. 1. Referring to the drawings, there is shown a fuel injection system for a diesel engine which is used to drive a road vehicle. The system includes a pump 11 supplying fuel to the engine 12, and an actuator 13 for determining the position of a control rod 14 forming part of the pump 11 and serving to set the pump output.

The rotational speed of the engine is sensed by a transducer 10 which produces an output voltage of the form indicated in FIG. 2. The transducer 10 provides an input by way of a resistor 30 to the inverting terminal of an operational amplifier 15 the output from which is fed through a diode 16 to a drive circuit 17. The operational amplifier 15 is connected as a summing amplifier, and for this purpose incorporates a feedback resistor 18 which is connected between the input terminal of the drive circuit 17 and to the inverting terminal of the amplifier 15. The non-inverting terminal of the amplifier 15 is connected to a terminal 19, and the power for the amplifier 15 is provided by way of a pair of terminals 21, 22. The terminals 19, 21, 22 provide the power for the entire system, and are coupled to a power supply circuit such that the terminal 21 is positive with respect to the terminal 22, and the terminal 19 is at a potential mid-way between the potentials of the terminals 21, 22. The horizontal axis in FIGS. 2 to 4 represents the potential of the terminal 19.

The pump output is sensed by a transducer 23 which is coupled to the control rod 14, and produces an output voltage of the form indicated in FIG. 3. The transducer 23 provides an input by way of a resistor 24 to the inverting terminal of the amplifier 15, and also provides an input by way of a resistor 25 to the inverting input of a second operational amplifier 26, the output of which is coupled through a diode 27 to the input terminal of the drive circuit 17. The amplifier 26 is coupled to the terminals 21, 22, 19 in the same way as the amplifier 15, and also receives an input from a current source 28 which sets the maximum fuel in a manner to be explained. The amplifier 26 is also a summing amplifier, and its feedback resistor 29 is connected between the input terminal of the drive circuit 17 and the inverting terminal of the amplifier 26.

The system further includes a demand transducer which in the example shown consists of the remaining components in FIG. 1. Thus, the demand transducer includes a square wave oscillator 31 which is powered by the terminals 21, 22 and which provides an input to the primary winding 32 of a transformer 33 having a secondary winding 34. The coupling between the windings 32, 34 is variable by a control member 35, which in the example shown is the accelerator pedal of the road vehicle. The accelerator pedal is movable progressively from a zero demand position to a maximum demand position, and varies the coupling between the windings 32, 34 progressively, the coupling being at a maximum in the zero demand position, and at a minimum in the maximum demand position.

One end of the winding 34 is connected to the terminal 19, and its other end is connected through a resistor 36, the cathode-anode path of a diode 37, and the anode-cathode path of diode 38 to the base of an n-p-n transistor 39. The junction of the resistor 36 and diode 37 is connected to the terminal 19 through a capacitor 41, and the junction of the diode 37, 38 is connected to the terminals 19, 21 through a capacitor 42 and a resistor 43 respectively. The transistor 39 has its collector connected to the terminal 22 through a resistor 43, and also connected through a resistor 44 to the base of a p-n-p transistor 45. The transistor 45 has its collector connected through a resistor 46 to the terminal 22, and its emitter connected through a resistor 47 to the terminal 22. The emitter of the transistor 45 is further connected through resisitors 48, 50 respectively to the inverting input of the amplifier 15 and to the terminal 19.

In the arrangement shown, the demand signal represents a predetermined engine speed. The amplifier 15 compares the demand signal with the input from the resistor 30 representing actual engine speed, and produces an output which is dependent on the difference between these two signals, and also on the signal it receives from the transducer 23 by way of the resistor 24. The purpose of the input representing pump output is to modify the output of the amplifier 15 in accordance with the pump output to give the desired engine characteristics. When the engine speed is not at the desired value, as modified by the input through the resistor 24, the amplifier 15 produces an output which acts through the drive circuit 17 to operate the actuator 13, so changing the pump output and modifying the engine speed until the input currents to the amplifier 15 are balanced, at which point the system is again in equilibrium and the pump output is substantially constant.

It will be appreciated that if the amplifier 15 is producing a positive output signal which is greater than the output of the amplifier 26, then the diode 27 will be reverse biased, and so the amplifier 26 plays no part in the operation of the system. However, if the pump output exceeds a maximum value which is predetermined by the current source 28, then the amplifier 26 produces a positive output which is greater than the positive output of the amplifier 15, so that the diode 16 is reverse biased, and the amplifier 26 provides an input to the drive circuit 17. It will of course be realised that a larger positive output from the amplifier 26 represents a demand for less fuel, and so the drive circuit decreases the pump output to hold the pump output at the predetermined level.

The required output from the demand transducer is shown in FIG. 4. It is desired that as the pedal is moved from its zero demand position to its maximum demand position, the current flowing in the resistor 48 increases as indicated by the part 51 of the curve until an intermediate output indicated by the point 52 is reached. Beyond the point 52, the current is to increase at a rate indicated by the portion 53 of the curve until a predetermined output 54 is reached. Beyond the predetermined output 54, the current through the resistor 48 is to be constant.

As previously explained, the coupling between the windings 32, 34 is at a maximum in the zero demand position. The resistor 36 and the capacitor 41 filter the signal in the winding 34. The signal is then rectified by the diode 37, and the capacitor 42 assumes a charge which is dependent upon the coupling between the winding 32, 34 so that the charge across the capacitor 42 reduces with demand. The capacitor 42 determines the base potential of the transistor 39, and so the transistor 39 conducts increasingly as the demand increases. The greater the conduction of the transistor 39, the smaller the current flowing through the resistor 44 to the base of the transistor 45. The arrangement is such that while the pedal is between the zero demand position and the point 52, then although the transistor 39 is conducting, sufficient current flows through the resistor 44 to saturate the transistor 45. A current now flows to the amplifier 15 through resistor 48, this current being determined by the resistors 44, 46, 47, 48 so that the portion 51 of the curve shown in FIG. 4 is obtained.

When the pedal reaches the point 52, there is sufficient voltage at the emitter of the transistor 39 to hold the transistor 45 in its amplifying mode. The current flowing through the resistor 48 is now determined by the resistors 47, 48, 50. This represents the portion 53 of the curve shown in FIG. 4.

When the point 54 is reached, the transistor 39 conducts sufficiently to turn the transistor 45 off. The current flowing in the resistor 48 is now determined by the resistors 47, 48, 50 and is constant. Thus, the desired output from the transducer is obtained by using the characteristics of the transistor 45.

It will of course be appreciated that the invention is not restricted to the particular form of fuel supply system shown. By way of example only, in an alternative arrangement, the engine is controlled by a two-speed governor, as distinct from the all-speed governor illustrated. In this arrangement, the pedal demands a predetermined pump output, as distinct from a predetermined speed. The amplifier 15 compares the demanded pump output with the actual pump output, and a signal from the transducer 10 is not required by the amplifier 15. In this case, the amplifier 26 receives a signal from the transducer 10, and compares the actual engine speed with a reference to set the maximum engine speed. This maximum engine speed may be varied in accordance with pump output, in which case the amplifier 26 still receives a signal from the transducer 23.

We claim:

1. A fuel system for an engine, including control means determining the rate of supply of fuel to the engine, and a demand transducer providing an input to the control means to influence the output thereof, said demand transducer comprising a control member movable progressively from a zero demand position to a maximum demand position, and a control network which when the control member is moved from the zero demand position produces an output which depends on the position of the control member until a predetermined position of the control member is reached, whereafter the control network produces an output which is substantially constant irrespective of the position of the control member, the output of said control network during movement of said control member from the zero demand position increasing at a first rate until an intermediate position is reached and then increasing at a second rate until said predetermined position is reached, and wherein the control network includes a transistor which provides the three required rates by virtue of being saturated, conductive but not saturated, and off respectively.

2. A system as claimed in claim 1 in which the transistor is saturated between the zero demand position and the intermediate position, conductive but not saturated between the intermediate and predetermined positions, and off when the control member is beyond the predetermined position.

* * * * *